US009994042B2

(12) United States Patent
Arce

(10) Patent No.: US 9,994,042 B2
(45) Date of Patent: Jun. 12, 2018

(54) SUBSTRATES AND METHOD FOR PRINT ENGRAVINGS

(71) Applicant: Victor Manuel Sud Arce, San Juan, PR (US)

(72) Inventor: Victor Manuel Sud Arce, San Juan, PR (US)

( * ) Notice: Subject to any disclaimer, the term of this patent is extended or adjusted under 35 U.S.C. 154(b) by 21 days.

(21) Appl. No.: 14/982,560

(22) Filed: Dec. 29, 2015

(65) Prior Publication Data

US 2016/0303845 A1 Oct. 20, 2016

Related U.S. Application Data

(60) Provisional application No. 62/148,316, filed on Apr. 16, 2015.

(51) Int. Cl.
*B41J 3/00* (2006.01)
*B41J 3/38* (2006.01)

(52) U.S. Cl.
CPC ..... *B41J 3/38* (2013.01)

(58) Field of Classification Search
CPC ..... B26F 1/00; B26F 1/38; G03F 1/38; G03F 1/42; B41J 3/38
See application file for complete search history.

(56) References Cited

U.S. PATENT DOCUMENTS 4,893,163 A * 1/1990 Rudeck ..... G03F 9/70 257/797
5,318,660 A * 6/1994 Olsen ..... B32B 37/0076 156/231
6,030,669 A 2/2000 Fascio
6,411,324 B1 * 6/2002 Christiansen ..... B41J 11/0065 347/234
7,182,007 B2 2/2007 Berge et al.
7,249,837 B2 7/2007 Abramek
7,815,190 B1 10/2010 Krisch et al.
2001/0048145 A1 * 12/2001 Takeuchi ..... G03F 9/7076 257/620
2003/0192182 A1 * 10/2003 Hiramatsu ..... H05K 3/0035 29/852
2004/0080949 A1 * 4/2004 Klotz ..... G09F 13/16 362/341
2005/0158668 A1 * 7/2005 Bittner ..... H05K 3/0079 430/322

(Continued)

*Primary Examiner* — David Banh
(74) *Attorney, Agent, or Firm* — PatentFile, LLC; Bradley C. Fach; Steven R. Kick

(57) ABSTRACT

A novel print engraving substrate is provided that when used with a cutting plotter, is able to improve the functioning of the cutting plotter. In some embodiments, a print engraving substrate may comprise a print engraving material forming a top surface; an adhesive material coupled to the print engraving material opposite to the top surface; a print engraving area disposed on the top surface; and a registration area disposed on the top surface which may receive one or more registration marks. The print engraving area may be configured to receive indicia such as cutting indicia which may be applied by a printer. The registration area may lack one or more colors or textures applied to the print engraving area thereby facilitating or allowing an optical scanner of a cutting plotter to detect registration marks on a substrate comprising a colored and/or textured print engraving area.

20 Claims, 7 Drawing Sheets

(56) References Cited

U.S. PATENT DOCUMENTS

| | | | | |
|---|---|---|---|---|
| 2007/0073443 | A1* | 3/2007 | Kurita | H01L 21/67265 700/245 |
| 2010/0304065 | A1* | 12/2010 | Tomantschger | B32B 15/08 428/35.8 |
| 2011/0265676 | A1* | 11/2011 | Golan | B41F 13/14 101/485 |
| 2012/0247293 | A1* | 10/2012 | Nagai | B26D 5/30 83/76.3 |
| 2012/0266728 | A1* | 10/2012 | Andersen | B26D 5/005 83/13 |
| 2012/0325064 | A1 | 12/2012 | Lee | |
| 2013/0330486 | A1* | 12/2013 | Shields | B44F 1/10 428/29 |
| 2015/0258699 | A1* | 9/2015 | Vander Woude | B26D 5/20 83/13 |

* cited by examiner

SUBSTRATES AND METHOD FOR PRINT ENGRAVINGS

CROSS REFERENCE TO RELATED APPLICATIONS

This application claims priority to and the benefit of the filing date of U.S. Provisional Application No. 62/148,316, filed on Apr. 16, 2015, entitled "SUBSTRATES AND METHOD FOR PRINT ENGRAVINGS", which is hereby incorporated by reference in its entirety.

FIELD OF THE INVENTION

This patent specification relates to the field of print engraving. More specifically, this patent specification relates to printing substrates and methods for use with automated engraving or cutting devices.

BACKGROUND

There are different methods of engraving or cutting substrates in order to shear webs of low-strength materials, such as rubber, fiber, foil, cloth, paper, corrugated fiberboard, paperboard, plastics, pressure-sensitive adhesive tapes, foam and sheet metal. One cost effective method of cutting substrates such as paper, card stock, mylar, vinyl, and the like comprises the use of cutting plotters. Cutting plotters use knives to cut into a substrate that is lying on the flat surface work area of the plotter. These cutting plotters may be connected to a computer equipped with specialized cutting design or drawing computer software programs which are able to send the necessary cutting dimensions or designs to the plotter in order to command the cutting knife to produce the correct project cutting needs into the substrate. Such tools allow desired shapes to be cut into a substrate very precisely, and repeated perfectly identically.

While cutting plotters are able to cut intricate designs in a substrate, they often rely on printers to apply graphics, indicia, and color applications initially onto the substrate. The substrate may also comprise one or more registration marks which may be optionally printed by the printer and used to align the substrate in a cutting plotter. Once the substrate has been printed, it may then be placed into a cutting plotter to make desired cuts, perforations, scoring, and the like onto the substrate. Unfortunately, once a substrate has been printed, the printing may interfere with detection of the registration marks on the substrate leading to inaccurate cutting and/or lost time and materials.

Therefore, a need exists for novel substrates for printer engraving. There also exists a need for novel methods of printer engraving. There is a further need for novel substrates and methods for use with printers and with automated engraving or cutting devices. Finally, there exists a need for novel substrates and methods for print engraving that do not interfere with detection of the registration marks on the substrate leading to inaccurate cutting and/or lost time and materials.

BRIEF SUMMARY OF THE INVENTION

A novel print engraving substrate is provided that when used with a cutting plotter, is able to improve the functioning of the cutting plotter by improving the ability of an optical scanner of the cutting plotter to read registration marks on a substrate which comprises a colored and/or textured print engraving area thereby increasing and/or perfecting alignment between the cutting knife and the cutting indicia on the top surface of the substrate.

In some embodiments, a print engraving substrate may comprise a print engraving material forming a top surface; an adhesive material coupled to the print engraving material opposite to the top surface; a print engraving area disposed on the top surface; and a registration area disposed on the top surface which may receive one or more registration marks. The substrate may also comprise a first elongate major side parallel to a second elongate major side and a first minor side parallel to a second minor side, and the first and second elongate major sides may be oriented generally perpendicular to the first and second minor sides. The print engraving area may be configured to receive indicia such as cutting indicia which may be applied by a printer. The registration area may lack one or more colors or textures applied to the print engraving area thereby facilitating or allowing an optical scanner of a cutting plotter to detect registration marks on a substrate comprising a colored and/or textured print engraving area.

According to another embodiment consistent with the principles of the invention, a method for print engraving a print engraving substrate is provided. The method may include applying indicia such as cutting indicia to the print engraving area of the substrate and applying one or more registration marks to a registration area of the substrate. Next, the substrate may be transferred to the cutting area of a cutting plotter. The optical scanner of the cutting plotter may then detect the position of the registration marks. The method may conclude once the cutting plotter has engraved or cut the substrate in the printable area relative to the registration marks.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
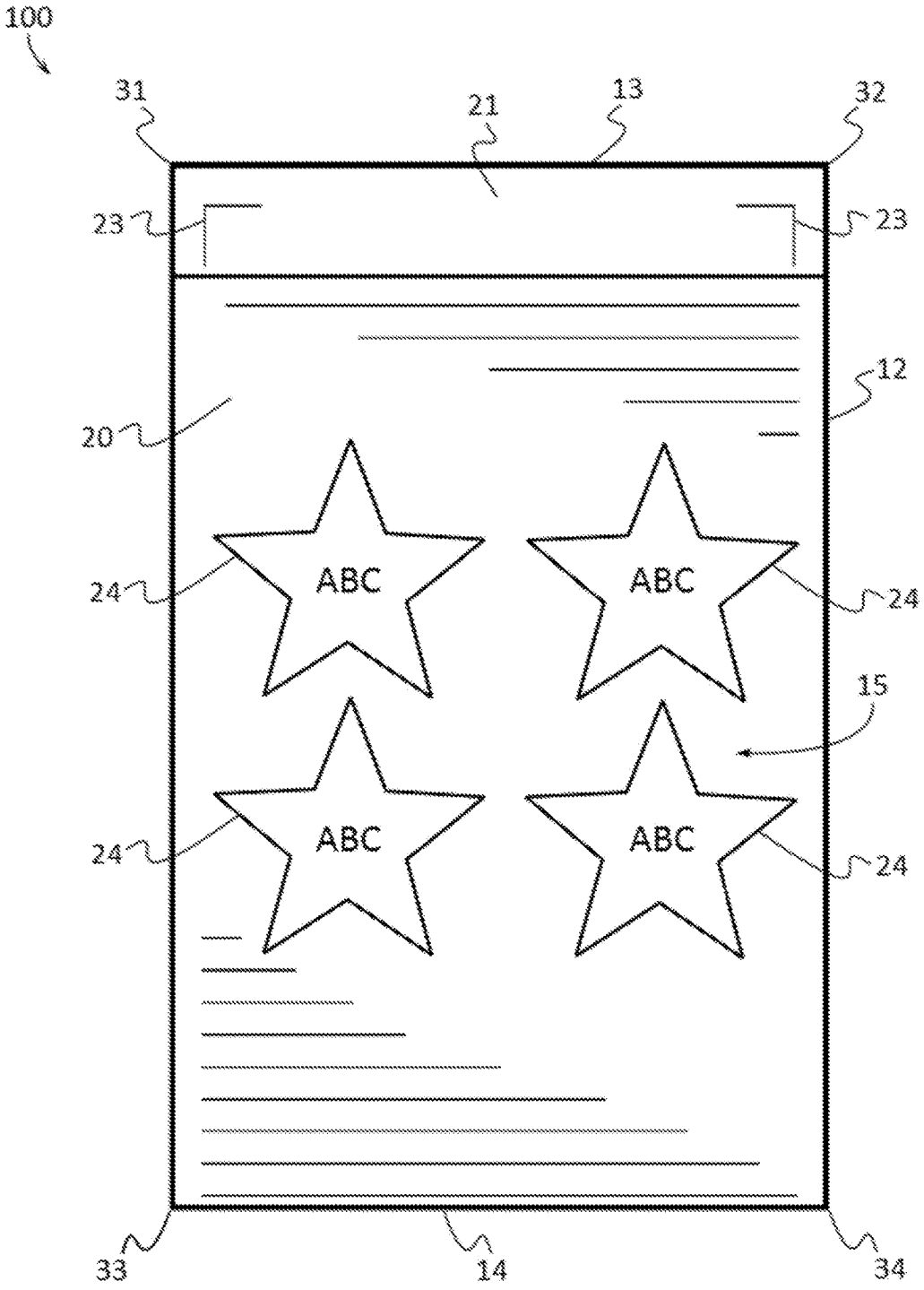
FIG. 1 depicts a top plan view of an example of a print engraving substrate comprising registration marks and printed indicia according to various embodiments described herein.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

New print engraving substrates and methods are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

The present invention will now be described by example and through referencing the appended figures representing preferred and alternative embodiments. FIG. 1 illustrates an example of a print engraving substrate 100 according to various embodiments. In some embodiments, a print engraving substrate ("the substrate") 100 may comprise a print engraving material 17 forming a top surface 15 of the substrate. An adhesive material 18 may be coupled to the print engraving material 17 opposite to the top surface 15. A first elongate major side 11 which may be parallel to a second elongate major side 12 and a first minor side 13 parallel to a second minor side 14 in which the first 11 and second 12 elongate major sides may be oriented generally perpendicular to the first 13 and second 14 minor sides. A print engraving area 20 and a registration area 21 may each be disposed on the top surface 15 with a registration mark 23. Optionally, the substrate 100 may comprise a liner 19 which may be coupled to the adhesive material 18 opposite to the print engraving material 17. As shown in FIG. 1, the registration area 21 may be configured to receive one or more registration marks 23, while the print engraving area 20 may be configured to receive indicia such as cutting indicia 24. Additionally, a registration area 21 may also lack one or more pigments, colors, textures, finishes, and the like, which is applied to the print engraving area 20.

Figure 2:
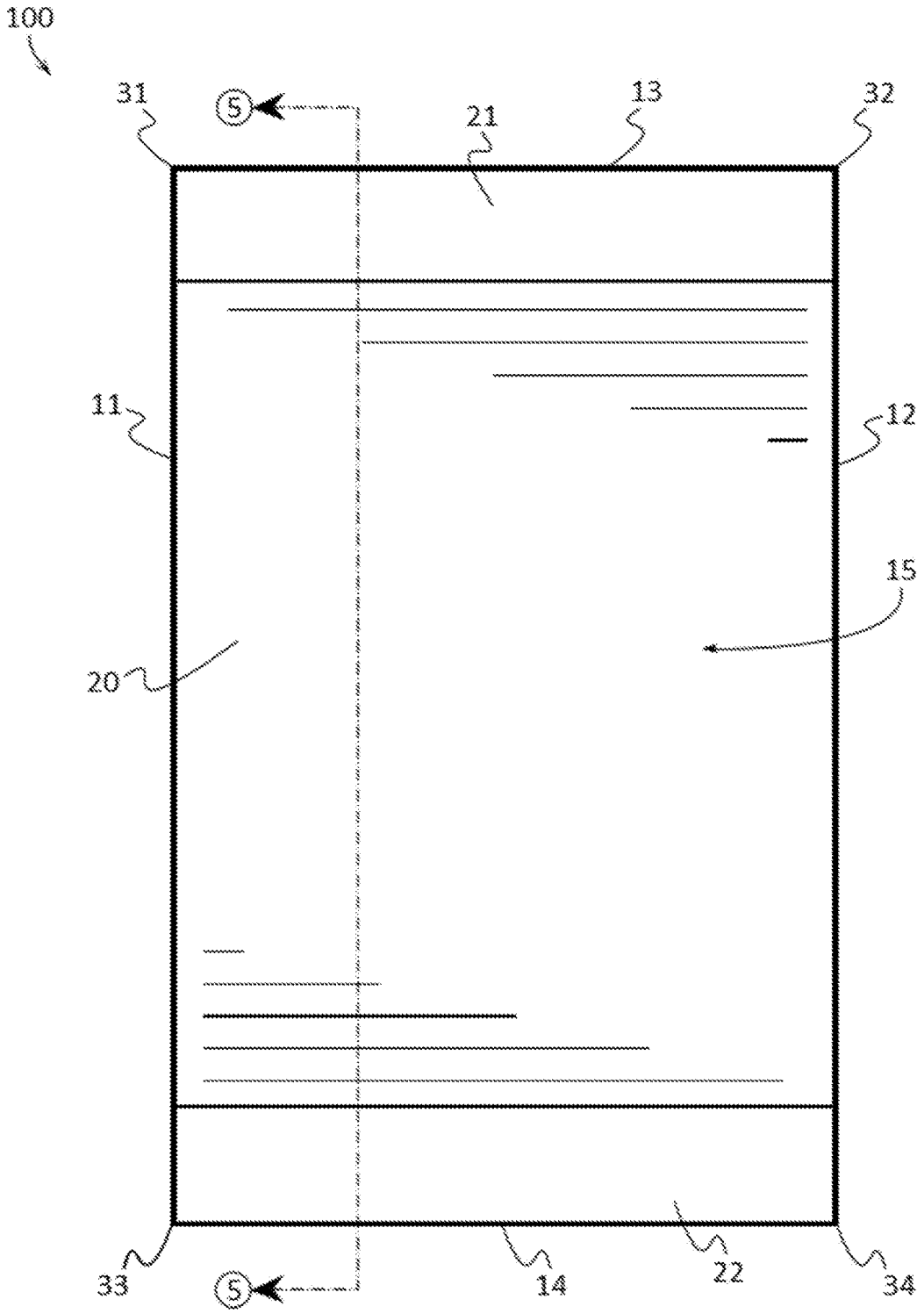
FIG. 2 illustrates a top plan view of an example of a print engraving substrate according to various embodiments described herein.
Figure 3:
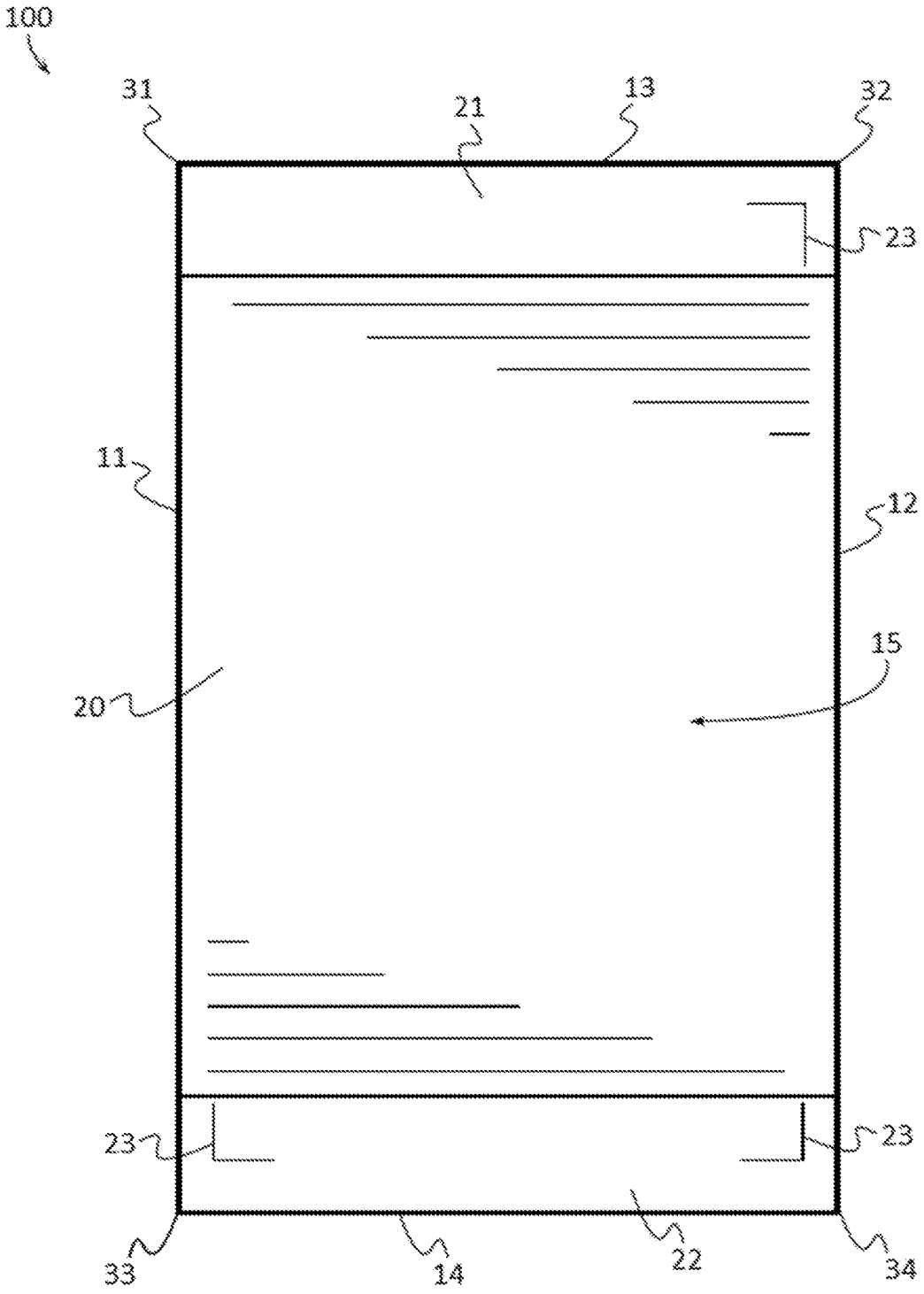
FIG. 3 shows a top plan view of an example of a print engraving substrate comprising registration marks according to various embodiments described herein.
Figure 4:
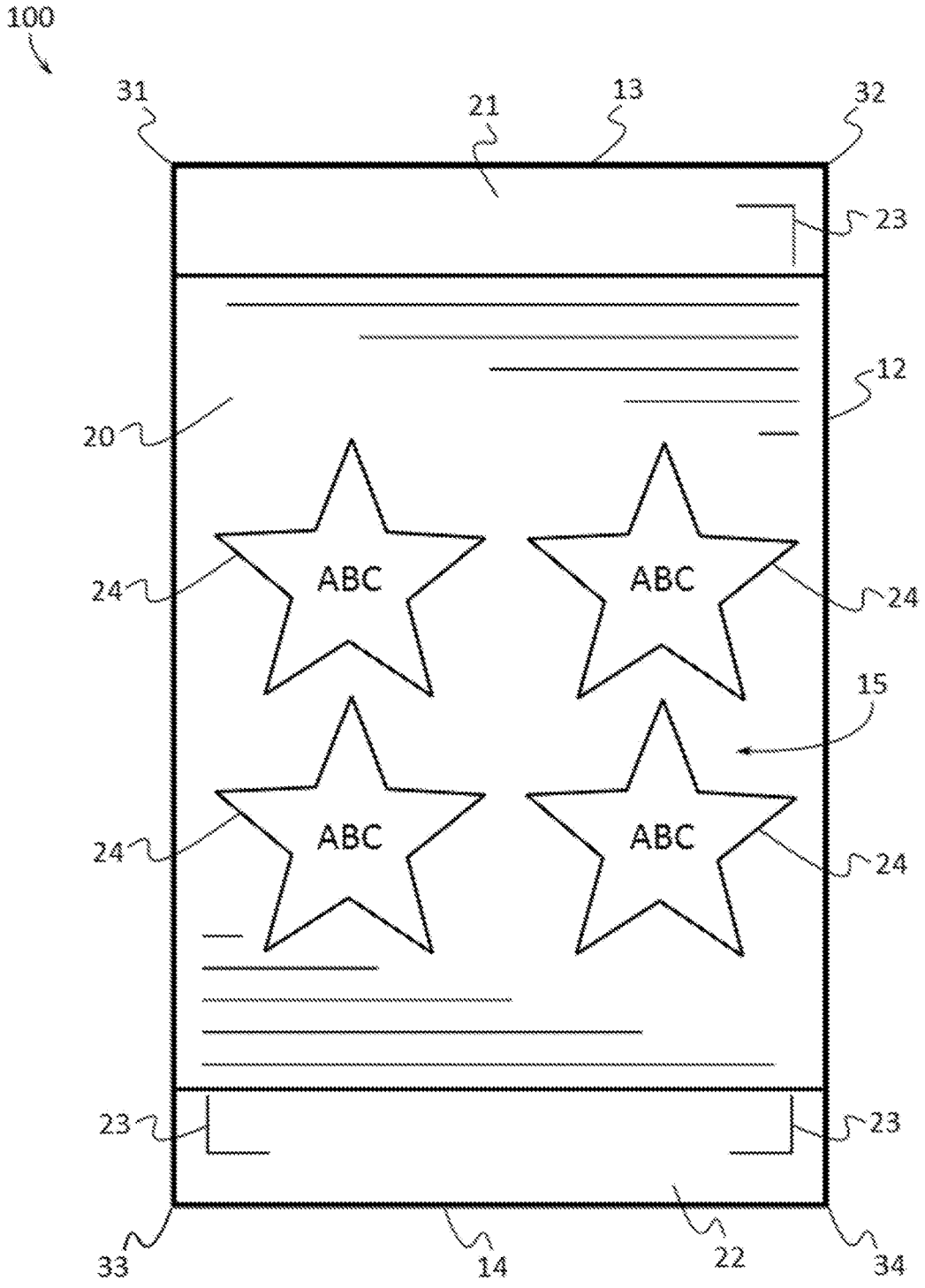
FIG. 4 depicts a top plan view of another example of a print engraving substrate comprising registration marks and printed indicia according to various embodiments described herein.
Figure 6:
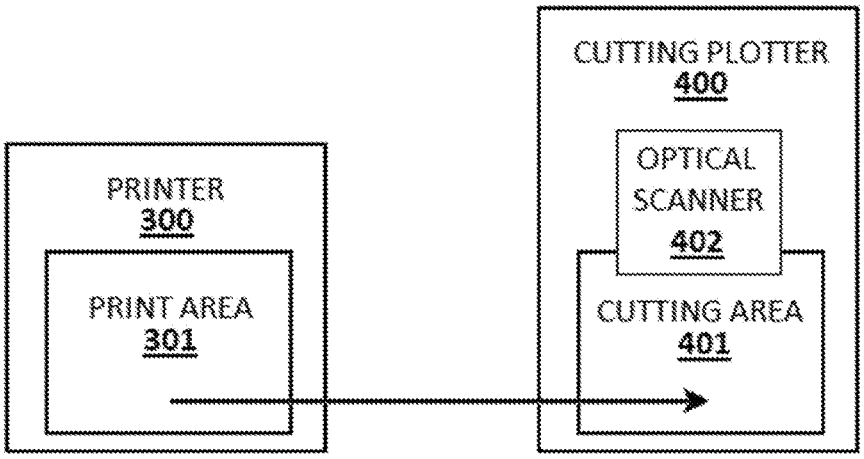
FIG. 6 shows a block diagram of an example of a printer and cutting plotter that may be used with a print engraving substrate according to various embodiments described herein.
Figure 7:
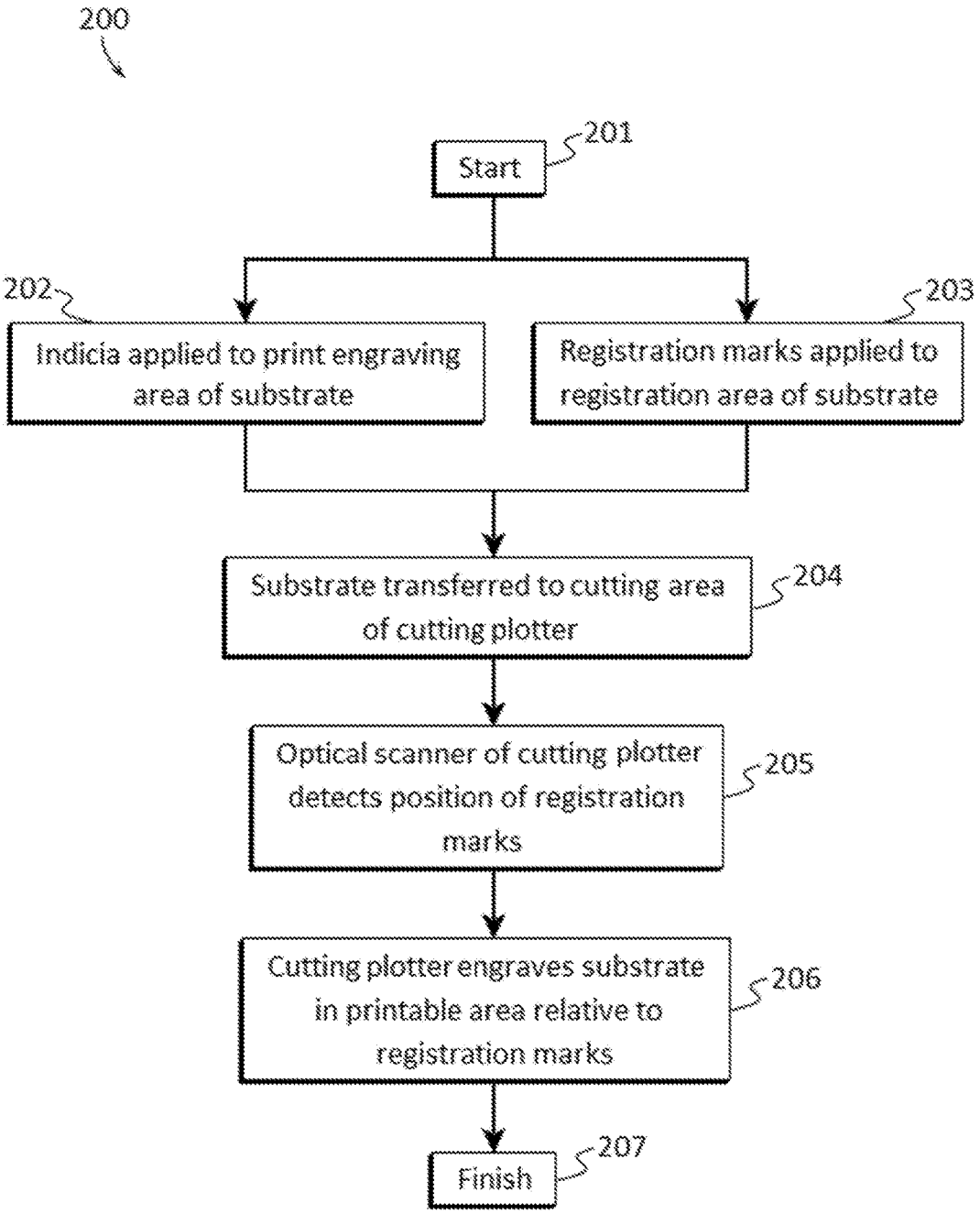
FIG. 7 depicts a block diagram of an example of a method for print engraving a substrate according to various embodiments described herein.

In preferred embodiments, a print engraving substrate 100 may comprise a shape and dimensions suitable for use with various types of printers 300 (FIG. 6) and cutting plotters 400 (FIG. 6). Generally, a printer 300 may be used to apply indicia, such as cutting indicia 24, graphics, and the like to the print engraving area 20. A printer 300 may also be used to apply one or more registration marks 23 to a registration area such as a first registration area 21 and/or to a second registration area 22 (FIGS. 2-4). Once the substrate 100 is transferred to a cutting plotter 400, the cutting plotter 400 may score or cut portions of the substrate 100 such as portions of the print engraving material 17. Optionally, the cutting plotter 400 may score or cut portions of the substrate 100 along a cutting indicia 24.

Turning now to FIG. 2, in some embodiments, the substrate 100 may comprise substantially rectangular dimensions with two generally parallel elongate major sides 11, 12, and two generally parallel minor sides 13, 14, with the major sides 11, 12, and minor sides 13, 14, oriented generally perpendicular to each other. In other embodiments, the substrate 100 may comprise a generally square shape with sides 11, 12, 13, 14, comprising substantially similar lengths. In further embodiments, the substrate may comprise one or more corners such as a first corner 31, second corner 32, third corner 33, and/or fourth corner 34. A first corner 31 may be formed by the intersection of the first minor side 13 with the first elongate major side 11. A second corner 32 may be formed by the intersection of the first minor side 13 with the second elongate major side 12. A third corner 33 may be formed by the intersection of the second minor side 14 with the second elongate major side 12. A fourth corner 34 may be formed by the intersection of the second minor side 14 with the first elongate major side 11. In some embodiments, one or more registration marks 23 may be printed in a first registration area 21 proximate to a first corner 31 and/or to a second corner 32. In some embodiments, one or more registration marks 23 may be printed in a second registration area 22 proximate to a third corner 33 and/or to a fourth corner 34.

In still other embodiments, it should be understood to one of ordinary skill in the art that the substrate 100 may be configured in a plurality of sizes and shapes with any number of sides including triangular shaped, circular or oval shaped, hexagon shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes may be made without departing from the spirit or scope of the invention.

As shown in FIGS. 1-4, a substrate 100 comprises a print engraving area 20 which may be formed by portions of a top surface 15. The print engraving area 20 is configured to receive indicia such as colors, patterns, shapes, graphics, letters, words, numbers, symbols, and the like which may be printed by a printer onto portions of the top surface 15 of a print engraving material layer 17. In the embodiment shown in FIGS. 1, 3, and 4, the print engraving area 20 may be bounded by a first 21 and a second 22 registration area positioned proximal to the minor sides 13, 14. In other embodiments, the print engraving area 20 may be bounded by a first 21 registration area positioned proximal to either of the minor sides 13, 14. In still other embodiments, the print engraving area 20 may be bounded by a first 21 registration area positioned proximal to either of the major sides 11, 12. In still other embodiments, the print engraving area 20 may be bounded by a first 21 and a second 22 registration area positioned proximal to the major sides 11, 12.

As perhaps best shown in FIGS. 1, 3, and 4, a registration area 21, 22, is configured to receive one or more registration marks 23 which may be printed by a printer onto portions of the registration area 21, 22, of the top surface 15 of a print engraving material layer 17. In some embodiments, a registration mark 23 may comprise a generally "L" shaped indicator which may be registered or detected by an optical scanner of a cutting plotter. In other embodiments, a registration mark 23 may comprise any shape, character, symbol, design, and the like which may be detected or registered by an optical scanner. A registration mark 23 may be contrasting in appearance to the appearance of a registration area 21, 22, on which it has been printed allowing an optical scanner 402 of a cutting plotter 401 to read a registration mark 23 within the registration area 21, 22, by detecting the contrast between the registration mark 23 and the registration area 21, 22.

In some embodiments, a substrate 100 may include a first registration area 21 which comprises a first registration mark 23. In further embodiments, a substrate 100 may include a second registration area 22 which comprises a second registration mark 23. In still further embodiments, a first registration area 21 may comprise a registration mark 23 proximate to the first elongate major side 11, and the second registration area 22 may comprise a second registration mark 23 proximate to the second elongate major side 12. In still further embodiments, the second registration area 22 may comprise a third registration mark 23 proximate to the first elongate major side 11.

In some embodiments, a substrate 100 may comprise a first 21 and/or second 22 registration area on the top surface 15. A registration area 21,22, may by positioned in a corner 31, 32, 33, 34, of the substrate 100 and extend along a portion of an elongate major side 11, 12, and along a portion of a minor side 13, 14. A first registration area 21 may be disposed proximate to the first minor side 13 and a second registration area may be disposed proximate to the second minor side 14. In further embodiments, a first registration area 21 may extend along a portion of each elongate major side 11, 12, and along the first minor side 13 extending from the first corner 31 to the second corner 32. In further embodiments, a second registration area 22 may extend along a portion of each elongate major side 11, 12, and along a portion of the second minor side 14 extending from the third corner 33 to the fourth corner 34. In still further embodiments, the substrate 100 may comprise a first registration area 21 that is disposed proximate to the first minor side 13. In further embodiments, a first registration area 21 may extend from the first elongate major side 11 to the second elongate major side 12.

A registration area 21, 22, may comprise a portion of a substrate 100 that does not comprise one or more colors or textures that a textured print engraving area 20 comprises allowing an optical scanner 402 of a cutting plotter 401 to read a registration mark 23 within the registration area 21, 22. In some embodiments, a substrate 100 may comprise a first registration area 21 and/or a second registration area 22. Similarly, a registration area 21, 22, may lack one or more pigments, colors, textures, finishes, and the like which has been applied to the print engraving area 20. In preferred embodiments, a registration area 21, 22, may lack one or more pigments so as to be generally white in appearance. In further preferred embodiments, a registration area 21, 22, may lack one or more finishes, such as a glossy, semi-glossy, foil, and the like, so as to be generally dull or matte in appearance. For example, a registration area 21, 22, may lack one or more pigments that is applied to the print engraving area 20 so as to appear white and comprise a registration mark 23 of a contrasting color such as black, red, green, blue, etc., while a print engraving area 20 may comprise yellow and black pigments creating a yellow zebra pattern. The optical scanner 402 may then read the colored registration mark 23 by detecting the contrast between the registration mark 23 and the white registration area 21, 22, allowing the cutting plotter 400 to align and orient the cutting knife to the cutting indicia 24 on a substrate 100 received in the cutting area 401. In another example, a registration area 21, 22, may be colored so as to appear black and a registration mark 23 may lack pigment so as to appear white while a print engraving area 20 may comprise a metallic blue coloring. The optical scanner 402 may then read the registration mark 23 by detecting the contrast between the registration mark 23 and the black registration area 21, 22, allowing the cutting plotter 400 to align and orient the cutting knife to the cutting indicia 24 on a substrate 100 received in the cutting area 401.

Figure 5:
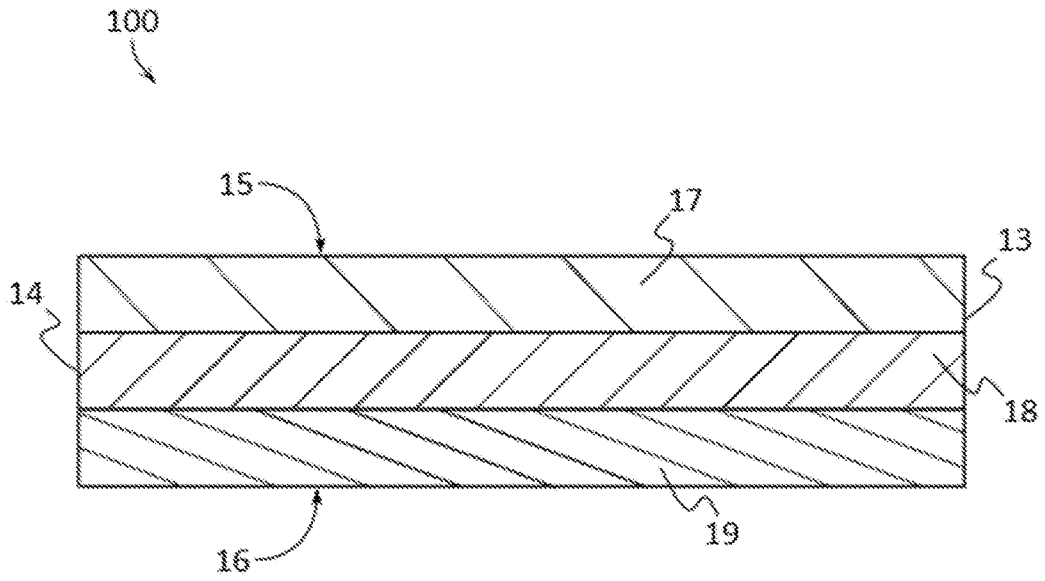
FIG. 5 illustrates a sectional, through line 2-2 shown in FIG. 1, elevation view of an example of a print engraving substrate according to various embodiments described herein.

Turning now to FIG. 5, a sectional, through line 5-5 shown in FIG. 2, elevation view of an example of a print engraving substrate 100 according to various embodiments described herein is illustrated. In this embodiment, the substrate 100 comprises a print engraving material 17, an adhesive material 18, and an optional liner 19, each of which may form a layer of the substrate. For example, a print engraving material 17 may form a print engraving material layer, an adhesive material 18 may form an adhesive material layer, and an optional liner 19 may form an optional liner layer. In other embodiments, a print engraving material 17, adhesive material 18, and/or liner 19 may only extend on or over portions of the substrate 100. In further embodiments, the substrate 100 may comprise two or more print engraving material layers 17, adhesive layers 18, and/or liner layers 19. In alternative embodiments, the substrate 100 may only comprise one or more print engraving material layers 17.

In some embodiments, a print engraving material 17 may comprise a material suitable for printing and engraving including, but not limited to, Bank paper, Banana paper, Bond paper, Book paper, Coated glossy paper, Coated matte surface paper, Construction paper, Sugar paper, Cotton paper, Fish paper, Inkjet paper, Kraft paper, Laid paper, Leather paper, Mummy paper, Oak Tag Paper, Sandpaper, Tyvek paper, Wallpaper, Washi, Waterproof paper, Wax paper, Wove paper, Xuan paper, and the like. In other embodiments, a print engraving material layer 17 may comprise a material suitable for printing and engraving including, but not limited to, vinyl or polyvinyl chloride (PVC) sheeting, such as gloss vinyl, matte vinyl, and scrim vinyl, polypropylene sheeting, magnetic sheeting, plastic sheeting, corrugated plastic, or any other type of material that may be printed on and engraved or cut with a cutting plotter.

An adhesive material 18 may be placed between a print engraving material layer 17 comprising the top surface 15 of the substrate 100 and a liner 19 optionally comprising the bottom surface 16 of the substrate 100. The adhesive material 18 may comprise a solvent-based adhesive, such as solvent-based acrylic adhesive, a water-based adhesive, or any other adhesive or mastic suitable for adhering to a print engraving material. A liner 19 may be adhered to the adhesive material 18 opposite the print engraving material 17 and may be configured to be peeled away or otherwise release from the adhesive material 18 allowing the adhesive layer 18 and print engraving material 17 to adhere to another material or surface. A liner 19 may comprise a paper or plastic-based film sheet used to prevent an adhesive material 18 from prematurely adhering. It may be coated on one or both sides with a release agent, such as crosslinkable silicone, which provides a release effect against any type of a sticky material such as an adhesive or a mastic.

FIG. 6 shows a block diagram of an example of a printer 300 and cutting plotter 400 that may be used with a print engraving substrate 100 according to various embodiments described herein. A printer 300 may comprise various types of printers, such as toner-based printers, liquid inkjet printers, solid ink printers, dye-sublimation printers, inkless printers, and the like. Generally, these printers 301 comprise a print area 301 upon which a printable substrate, such as the substrate 100, may be placed and a print head configured to apply indicia onto the printable substrate within the print area. Printers 300 may comprise print areas 301 with a plurality of sizes and dimensions, but typically comprise dimensions suitable for accommodating printable substrates 100 with Letter (8.5"×11"), A4 (8.27"×11.69"), Legal (8.5"×14"), Tabloid (11"×7"), B3 (14.33"×20.27"), poster size, and/or other larger or smaller custom sizes.

Typically, a cutting plotter 400 is identical to a traditional plotter except that the ink pen is replaced by a very sharp knife that is used to cut out shapes, and the plotter 400 may have a pressure control to adjust how hard the knife presses down into a substrate such as vinyl film, or in this example a print engraving substrate 100, allowing designs to be fully cut out of or partly cut out or engraved into the print engraving material 17. Once a substrate 100 has been printed with indicia, such as cutting indicia 24, and a registration mark 23, it may be transferred to a cutting plotter 400 which may engrave or cut the substrate 100 optionally on or along cutting indicia 24. Often it is preferred that only the upper layer, such as the print engraving material 17 is cut on a cutting indicia 24, while the liner 19 is not completely cut through. Completely loose pieces cut out of the liner 19 may fall out and jam the plotter 400 or result in other difficulties. Cutting plotters 400 commonly comprise a cutting area 401 configured to receive a substrate 100 and an optical scanner 402 configured to align and orient the cutting knife to the cutting indicia 24 on a substrate 100 received in the cutting area 401. The optical scanner 402 may optically read or detect one or more registration marks 23 on a registration area 21, 22, and based on programmed information about the positioning of the registration marks 23 relative to cutting indicia 24 cut the cutting indicia 24 on the substrate 100. An optical scanner 402, sometimes referred to as a registration mark sensor or color contrast sensor, acts as a registration mark 23 detector by detecting contrast between a registration mark 23 and the area a registration mark 23 has been printed on to inspect registration marks and by identifying the shape of the registration mark 23. An optical scanner 402 may comprise a contrast sensor, a color sensor, a luminescence sensor, an array sensor, a fork sensor, a glare sensor, or any other type of optical sensor.

However, many of these sensors can be very expensive. The substrate 100 can be used with inexpensive optical scanners, such as color sensors, which where heretofore unable to detect low contrast registration marks 23 printed on colored or textured substrates. With traditional substrates, the print engraving area covers the entire top surface of the traditional substrate. For traditional substrates comprising a print engraving area with a colored or patterned upper surface, the registration marks on these traditional substrates must be printed or applied on the colored or patterned upper surface. When transferred to a cutting plotter, the optical scanner often misreads or is unable to read the registration marks resulting in misaligned and improper cutting of the cutting indicia. For this reason print engraving on traditional substrates has resulted in wasted substrate material and increased costs, if not preventing print engraving on traditional substrates with a colored or patterned upper surface.

The novel print engraving substrate 100 when used with a cutting plotter 400, is able to improve the functioning of the cutting plotter 400 by improving the ability of an optical scanner 402 of the cutting plotter 400 to read registration marks 23 on a substrate 100 which comprises a colored and/or textured print engraving area 20 thereby increasing and/or perfecting alignment between the cutting knife and the cutting indicia 24 on the top surface 15 of the substrate 100.

Now referring to FIG. 5, a block diagram of an example of a method for print engraving a substrate ("the method") 200 according to various embodiments described herein is illustrated. The method 200 may start 201 with applying cutting indicia 24 (FIGS. 1 and 4) to the print engraving area 20 (FIGS. 1-4) of a print engraving substrate 100 (FIGS. 1-5) in step 202 and applying one or more registration marks 23 (FIGS. 1, 3, and 4) to a registration area 21, 22 (FIGS. 1-4) of a print engraving substrate 100 in step 203. In some embodiments, step 202 may be completed by a printer 300 (FIG. 6) which is configured to perform both steps 202 and 203 while the substrate 100 is positioned in the print area 301 (FIG. 6) allowing steps 202 and 203 to be completed generally in a simultaneous or sequential manner. In other embodiments, steps 202 and 203 may be completed at different times such as by performing step 202 first and step 203 second, or by performing step 203 first and step 202 second. In further embodiments, steps 202 and 203 may be performed by different printers 300.

Next, in step 204 the substrate 100 comprising one or more registration marks 23 in one or more registration areas 21, 22 and cutting indicia 24 on a print engraving area 20 may be transferred to the cutting area 401 (FIG. 6) of a cutting plotter 400 (FIG. 6). The optical scanner 402 (FIG. 6) may then optically detect or read the registration marks 23 on a substrate 100 in step 205. Since the substrate 100 comprises one or more registration areas 21, 22, that have been printed with one or more registration marks 23, the optical scanner 402 of the cutting plotter 400 may detect the registration marks 23 even if the print engraving area 20 comprises colors, patterns, and/or indicia that may otherwise interfere with detection of the registration marks 23 by the optical scanner 402 of a cutting plotter 400. The substrate 100 can be used with inexpensive optical scanners 402, such as color sensors, which where heretofore unable to detect low contrast registration marks 23 printed on colored or textured substrates.

Based on programmed information, such as entered by a user into the computer controlling the cutting plotter 400, about the positioning of the registration marks 23 in one or more registration areas 21, 22 relative to cutting indicia 24 the cutting plotter 400 may engrave or cut the cutting indicia 24 on the substrate 100 relative to the registration marks 23 in step 206. Upon the completion of cutting or engraving the cutting indicia 24, relative to the registration marks 23, the method 200 may finish 207.

Figure 8:
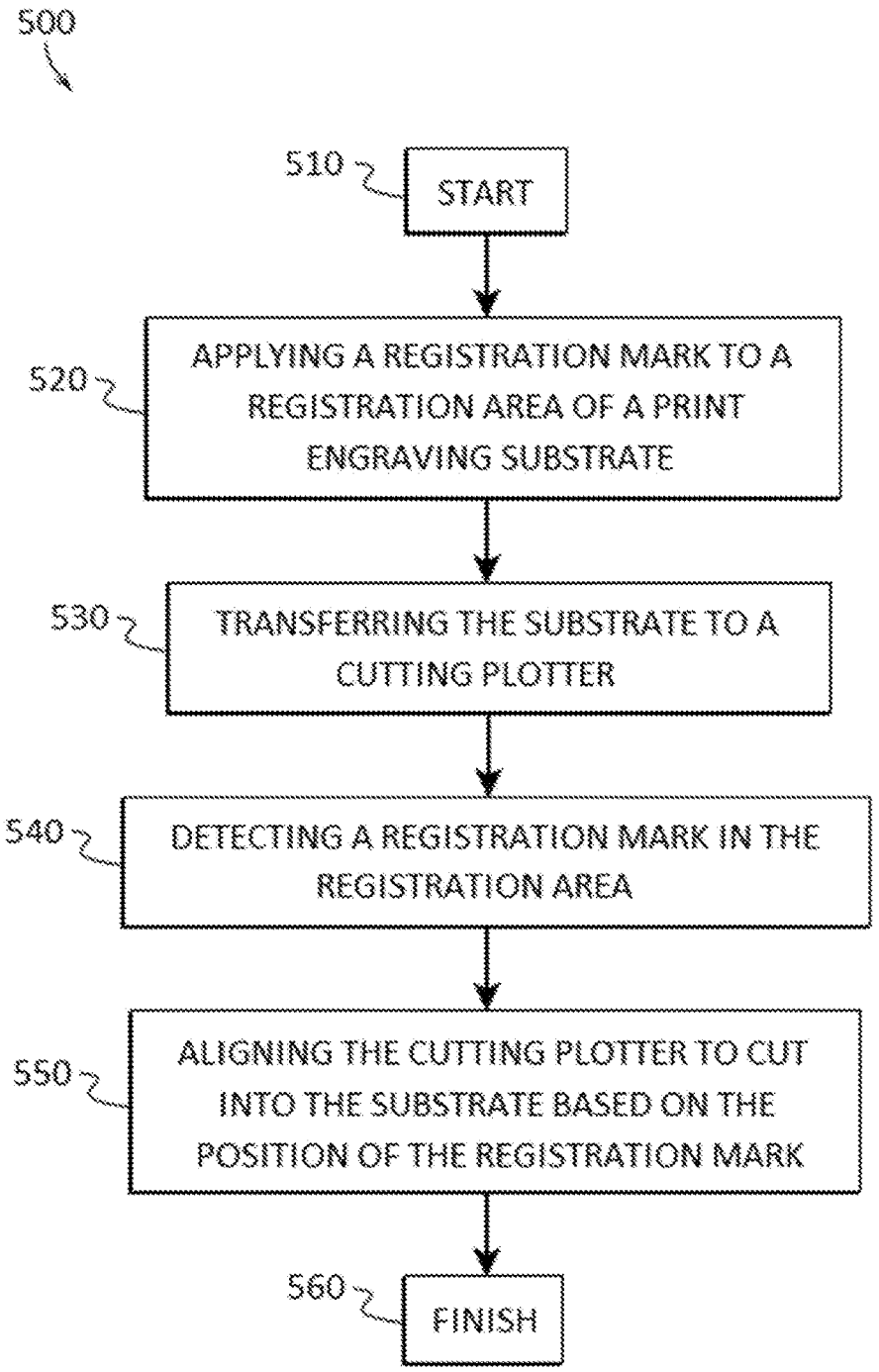
FIG. 8 illustrates a block diagram of an example of a method for calibrating a cutting plotter according to various embodiments described herein.

FIG. 8 illustrates a block diagram of an example of a method for calibrating a cutting plotter ("the method") according to various embodiments described herein. The method 500 may start 510 and one or more registration mark s 23 may be applied to one or more registration areas 21,22, of a print engraving substrate 100. In some embodiments, a first registration mark 23 may be applied to a first registration area 21 proximate to the first minor side 13 and a second registration mark 23 may be applied to a second registration area 22 proximate to the second minor side 14. In still further embodiments, a third registration mark 23 may be applied to a first registration area 21 and/or a second registration area 22 proximate to an elongate major side 11, 12. In further embodiments, step 520 may be carried out by a printer 300 while the substrate is in a print area 301.

Next in step 530, the substrate 100 may be transferred to a cutting plotter 400. In some embodiments, the substrate 100 may be transferred from a print area 301 of a printer 300 to the cutting area 401 of a cutting plotter 400. The cutting plotter 400 may comprise an optical scanner 402 positioned proximate to the cutting area 401.

In step 540, a registration mark 23 in the registration area may be detected by the optical scanner 402 of the cutting plotter 400. In further embodiments, the optical scanner 402 may detect two, three, or more registration marks 23 in a first registration area 21 and/or in a second registration area 22.

Next in step 550, the cutting plotter 400 may be aligned to cut into the substrate 100 based on the position of the one or more registration mark 23 detected in step 540. Based on positional information supplied to the cutting plotter 400, the cutting plotter 400 may use the locations of one or more registration marks 23 to align its cutting head to the supplied positional information. In some embodiments, the cutting plotter 400 may cut or engrave the print engraving material 17 of the substrate 100 without cutting completely through the substrate. In further embodiments, the cutting plotter 400 may cut or engrave the print engraving material 17 of the substrate 100 without cutting completely through an optional liner 19 of the substrate 100. After step 550, the method 500 may finish 560.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A print engraving substrate for use with a cutting plotter, the substrate comprising:

a print engraving material forming a top surface;

an adhesive material coupled to the print engraving material opposite to the top surface;

a first elongate major side parallel to a second elongate major side and a first minor side parallel to a second minor side, and wherein the first and second elongate major sides are oriented generally perpendicular to the first and second minor sides;

a print engraving area disposed on the top surface and spaced apart from the first and second minor sides, the print engraving area having a colored and textured surface creating a first optical profile;

a first white non-colored registration area disposed on the top surface and spaced apart from the print engraving area, the first white non-colored registration area located between the print engraving area and the first minor side, the first white non-colored registration area having a second optical profile, the second optical profile being optically distinguishable from the first optical profile; and a first registration mark positioned within the first white non-colored registration area proximate to the first minor side.

2. The substrate of claim 1, further comprising a liner coupled to the adhesive material opposite to the print engraving material.

3. The substrate of claim 1, wherein the white non-colored registration area is disposed proximate to the first minor side.

4. The substrate of claim 3, wherein the white non-colored registration area extends from the first elongate major side to the second elongate major side.

5. The substrate of claim 3, wherein the top surface comprises a first white non-colored registration area and a second white non-colored registration area.

6. The substrate of claim 5, wherein the first white non-colored registration area is disposed proximate to the first minor side, and wherein the second white non-colored registration area is disposed proximate to the second minor side.

7. The substrate of claim 6, wherein the first white non-colored registration area extends from the first elongate major side to the second elongate major side, and wherein the second white non-colored registration extends from the first elongate major side to the second elongate major side.

8. The substrate of claim 6, wherein the first white non-colored registration area comprises a first registration mark, and wherein the second white non-colored registration area comprises a second registration mark.

9. The substrate of claim 8, wherein the first white non-colored registration mark is proximate to the first elongate major side, and wherein the second white non-colored registration mark is proximate to the second elongate major side.

10. The substrate of claim 9, wherein the second white non-colored registration area comprises a third registration mark proximate to the first elongate major side.

11. A method for print engraving a print engraving substrate, the method comprising:

providing a print engraving material forming a top surface of the substrate;

providing an adhesive material coupled to the print engraving material opposite to the top surface;

providing a first elongate major side parallel to a second elongate major sides and a first minor side parallel to a second minor side, and wherein the first and second elongate major sides are oriented generally perpendicular to the first and second minor;

providing a print engraving area disposed on the top surface, the print engraving area having a colored and textured surface creating a first optical profile;

providing a registration area disposed on the top surface, the registration area spaced apart from and optically distinguishable from the print engraving area and having a second optical profile, the registration area having a white non-colored surface void of a textured surface, a metallic surface, and a colored surface; and the method comprising the steps of:

i. applying indicia and texture to the print engraving area of the substrate;

ii. applying a colored registration mark to the registration area of the substrate;

iii. transferring the substrate to the cutting area of a cutting plotter;

iv. detecting the position of the registration mark within the registration area with an optical scanner of the cutting plotter but not detecting a registration mark within the print engraving area; and v. engraving the substrate in the print engraving area relative to the registration marks with the cutting plotter.

12. The method of claim 11, wherein the substrate further comprises a liner coupled to the adhesive material opposite to the print engraving material and wherein the cutting plotter cuts fully through the top surface of the print engraving area without cutting completely through the liner.

13. The method of claim 11, wherein the registration area is disposed proximate to the first minor side.

14. The method of claim 13, wherein the registration area extends from the first elongate major side to the second elongate major side.

15. The method of claim 13, wherein the top surface comprises a first registration area and a second registration area.

16. The method of claim 15, wherein the first registration area is disposed proximate to the first minor side, and wherein the second registration area is disposed proximate to the second minor side.

17. The method of claim 16, wherein the first registration area is disposed proximate to the first minor side and extends from the first elongate major side to the second elongate major side, and wherein the second registration area is disposed proximate to the second minor side and extends from the first elongate major side to the second elongate major side.

18. The method of claim 16, wherein the first registration area comprises a first registration mark, and wherein the second registration area comprises a second registration mark.

19. A print engraving substrate for use with a cutting plotter, the substrate comprising:

a print engraving material forming a top surface;

an adhesive material coupled to the print engraving material opposite to the top surface;

a first elongate major side parallel to a second elongate major side and a first minor side parallel to a second minor side, and wherein the first and second elongate major sides are oriented generally perpendicular to the first and second minor sides;

a print engraving area disposed on the top surface and spaced apart from the first and second minor sides, the print engraving area having a first optical profile and the print engraving area made up of a metallic and colored surface;

a first white registration area disposed on the top surface and spaced apart from the print engraving area, the first registration area located between the print engraving area and the first minor side, the first white registration area having a second optical profile, the second optical profile being optically distinguishable from the first optical profile and the first white registration area having a non-metallic surface; and a first registration mark positioned within the first white registration area proximate to the first minor side.

20. The substrate of claim 19, further comprising a liner coupled to the adhesive material opposite to the print engraving material having a metallic surface.

* * * * *